US007026540B1

(12) United States Patent
Doleski et al.

(10) Patent No.: US 7,026,540 B1
(45) Date of Patent: Apr. 11, 2006

(54) TAILCONE ASSEMBLY FOR A SUBMARINE COUNTERMEASURE

(75) Inventors: Robert F. Doleski, Middletown, RI (US); Stephen F. Oliver, Portsmouth, RI (US); Stanley J. Olson, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/099,777

(22) Filed: Apr. 4, 2005

(51) Int. Cl.
*F42B 19/00* (2006.01)

(52) U.S. Cl. ..... 114/20.1; 114/238; 114/22; 89/1.81

(58) Field of Classification Search ..... 114/20.1, 114/20.2, 22, 238; 89/1.81, 1.819; 244/3.24, 244/3.23, 3.3
See application file for complete search history.

(56) References Cited

U.S. PATENT DOCUMENTS 1,295,355 A * 2/1919 Myers ..... 114/20.1
3,873,048 A * 3/1975 Platou ..... 244/3.1
5,308,270 A 5/1994 Travor et al.
5,396,855 A 3/1995 Dubois
5,464,172 A 11/1995 Jensen et al.
5,514,023 A 5/1996 Warner
5,615,847 A 4/1997 Bourlett
5,806,791 A * 9/1998 Hatalsky et al. ..... 244/3.24
5,918,307 A 6/1999 Cipolla
5,942,712 A 8/1999 Mello
6,039,287 A 3/2000 Liston et al.
6,079,310 A 6/2000 Yagla et al.
6,164,179 A 12/2000 Buffman

* cited by examiner

*Primary Examiner*—Michael J. Carone
*Assistant Examiner*—Gabriel J. Klein
(74) *Attorney, Agent, or Firm*—James M. Kasischke; Jean-Paul A. Nasser; Michael P. Stanley

(57) ABSTRACT

A tailcone assembly for a submarine countermeasure includes a generally hemispherically shaped shell having a planar aft end and an annular open forward end. Fins are fixed to the shell equidistantly around the shell externally thereof, each of the fins having a planar outboard surface extending aft and inboard of the shell. Connector structure is on the forward end of the shell for connecting to an aft end of the countermeasure. A first aperture is disposed in a side of the shell and a cable extends from inside the shell therethrough. A second aperture extends through one of the fins and the cable extends therethrough. An opening is disposed centrally of the shell aft end, extends therethrough, and is adapted to retain a shaft assembly therein.

12 Claims, 7 Drawing Sheets

TAILCONE ASSEMBLY FOR A SUBMARINE COUNTERMEASURE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1. Field of the Invention

The invention relates to a submarine countermeasure apparatus and is directed more particularly to an improved tailcone assembly therefor.

2. Description of the Prior Art

In FIG. 1, there is shown a typical submarine countermeasure apparatus 20. The apparatus 20 includes a launch tube 22 which, in operation, is disposed outboard of the submarine pressure hull (not shown). A countermeasure 24 is housed in the launch tube 22 and includes an array assembly 26 and a tailcone assembly 28. The array assembly 26 is protected by a surrounding sabot 30. Disposed in the launch tube 22 is a ram plate 32 and a gas generator 34. The launch tube is closed by a forward tube cover 36 and an after tube cover 38.

In operation, the gas generator 34 is activated by an electrical pulse from the submarine fire control system and generates sufficient gas pressure to move the ram plate 32 forwardly. The ram plate 32 pushes the countermeasure 24 forwardly, breaking away the forward tube cover 36 and launching the countermeasure 24 from the launch tube 22. In short order, the sabot 30 disengages from around the array assembly 26 and the array assembly is activated to produce acoustic energy.

It has been found that upon launch of the current countermeasure 24, a joint 40 between the tailcone assembly 28 and a body portion 42 of the countermeasure apparatus 20 is sometimes subjected to substantial bending moments. The current tailcone assembly 28, in particular, is subjected to such bending moments during launch out of the launch tube 22. The bending moments sometimes result in vehicle 24 joint damage and launch or deployment failure. The ram plate 32 pushes against the tailcone assembly 28 with a force in thousands of pounds. Bending moments on the countermeasure apparatus 24, caused by water impacting the side of the countermeasure 24 as it exits the launch tube 22 perpendicular to the water vectors while the submarine is underway, can be in thousands of foot-pounds.

Accordingly, there is a need for an improved tailcone assembly which can withstand and/or minimize severe bending moments.

SUMMARY OF THE INVENTION

An object of the invention is, therefore, to provide an improved tailcone assembly for a submarine countermeasure apparatus, the tailcone assembly being structured for successful launch and deployment under conditions inflicting potentially high bending moments upon the countermeasure apparatus.

With the above and other objects in view, a feature of the invention is the provision of a tailcone assembly for a submarine countermeasure. The assembly comprises a generally hemispherically shaped shell having a planar aft end and an annular open forward end, at least three fins fixed to the shell equidistantly around the shell externally thereof, each of the fins having a planar outboard surface extending aft and inboard of the shell. A connector structure is disposed on the forward end of the shell for connecting to an aft end of the countermeasure. A first aperture is disposed in a side of the shell and a cable extends from inside the shell therethrough. A second aperture extends through one of the fins and the cable extends through the second aperture. An opening is disposed centrally of the shell aft end, extends therethrough, and is adapted to retain a shaft assembly therein.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, and wherein corresponding reference characters indicate corresponding parts throughout the several views of the drawings and wherein.

DESCRIPTION OF THE PREFERRED EMBODIMENTS

Figure 2:
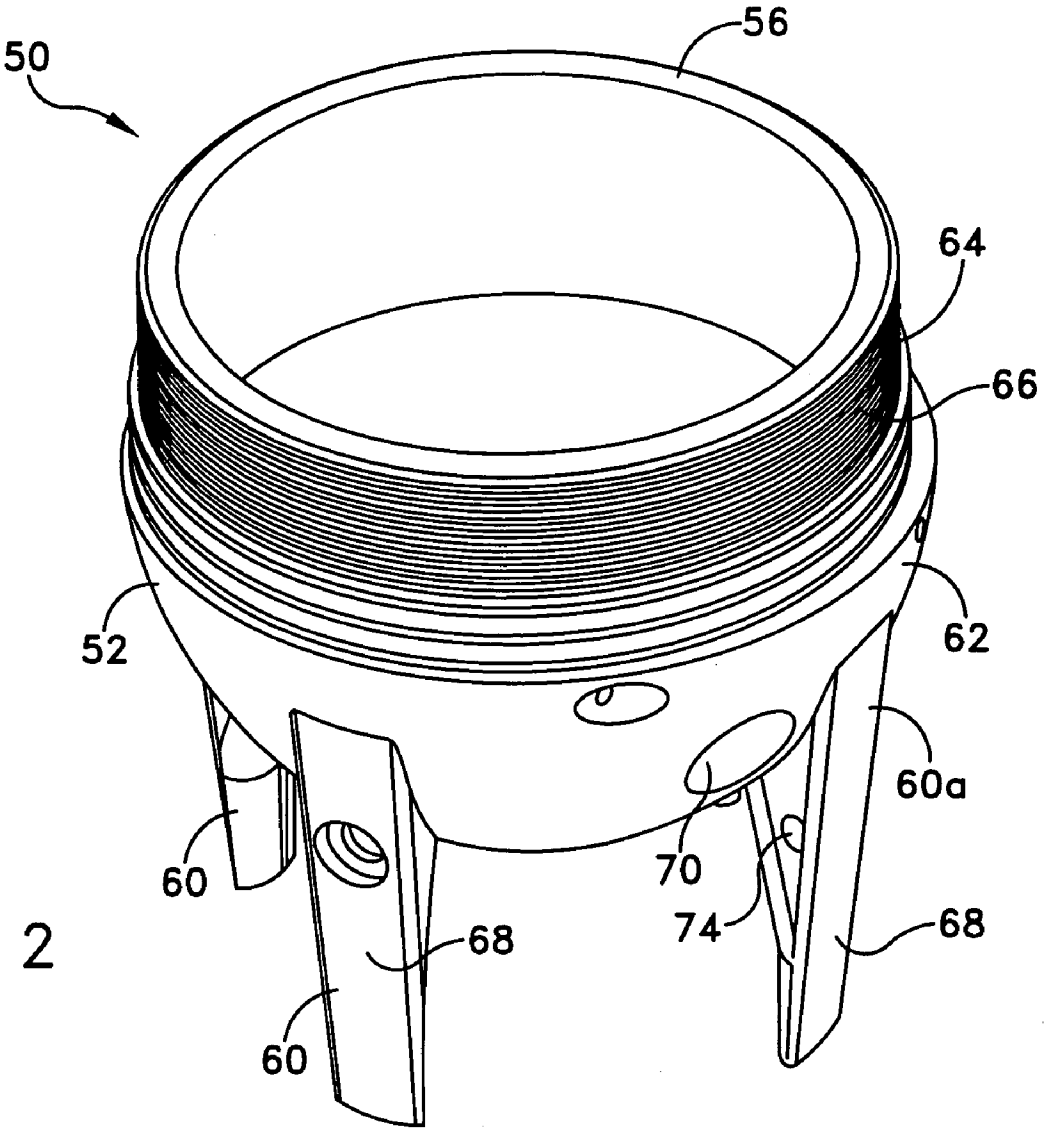
FIG. 2 is a perspective view of one form of tailcone illustrative of an embodiment of the invention.
Figure 3:
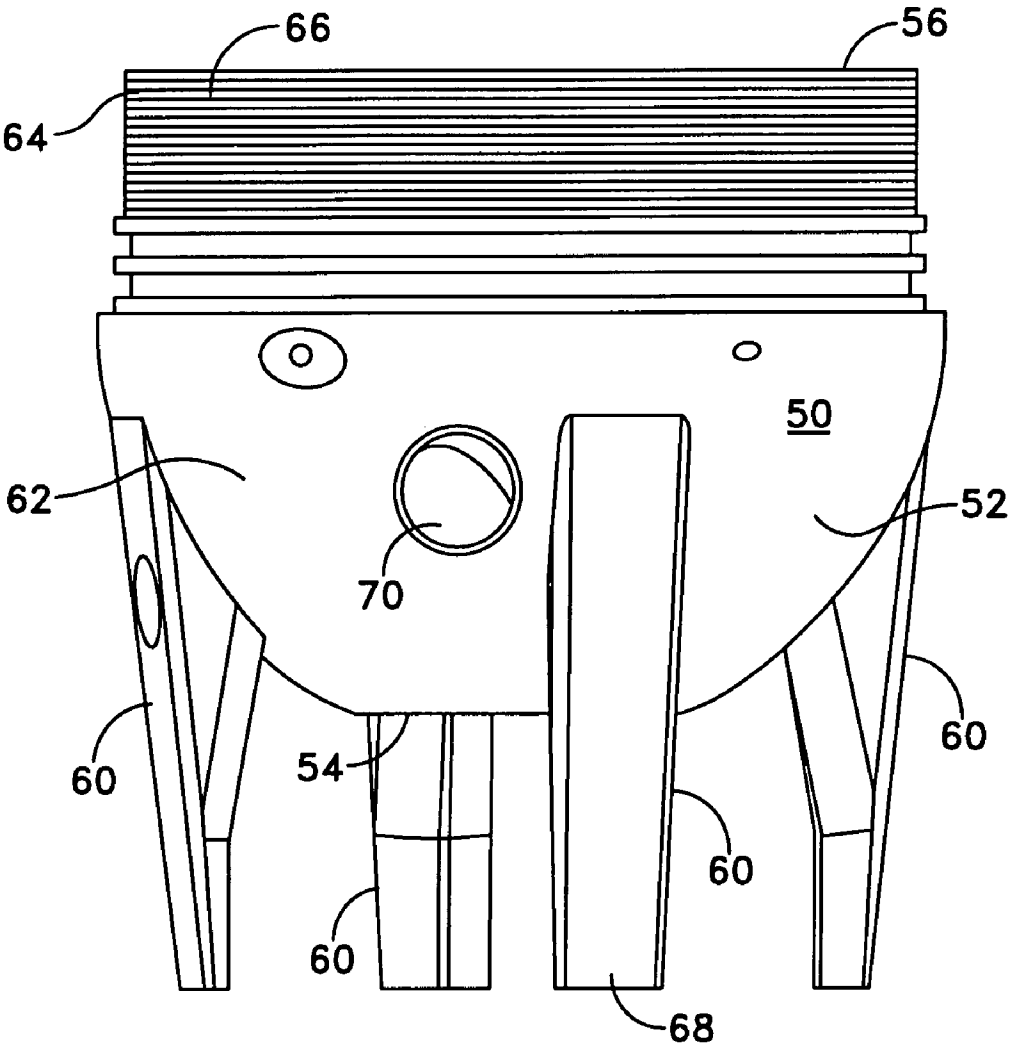
FIG. 3 is a side elevational view of the tailcone of FIG. 2.
Figure 4:
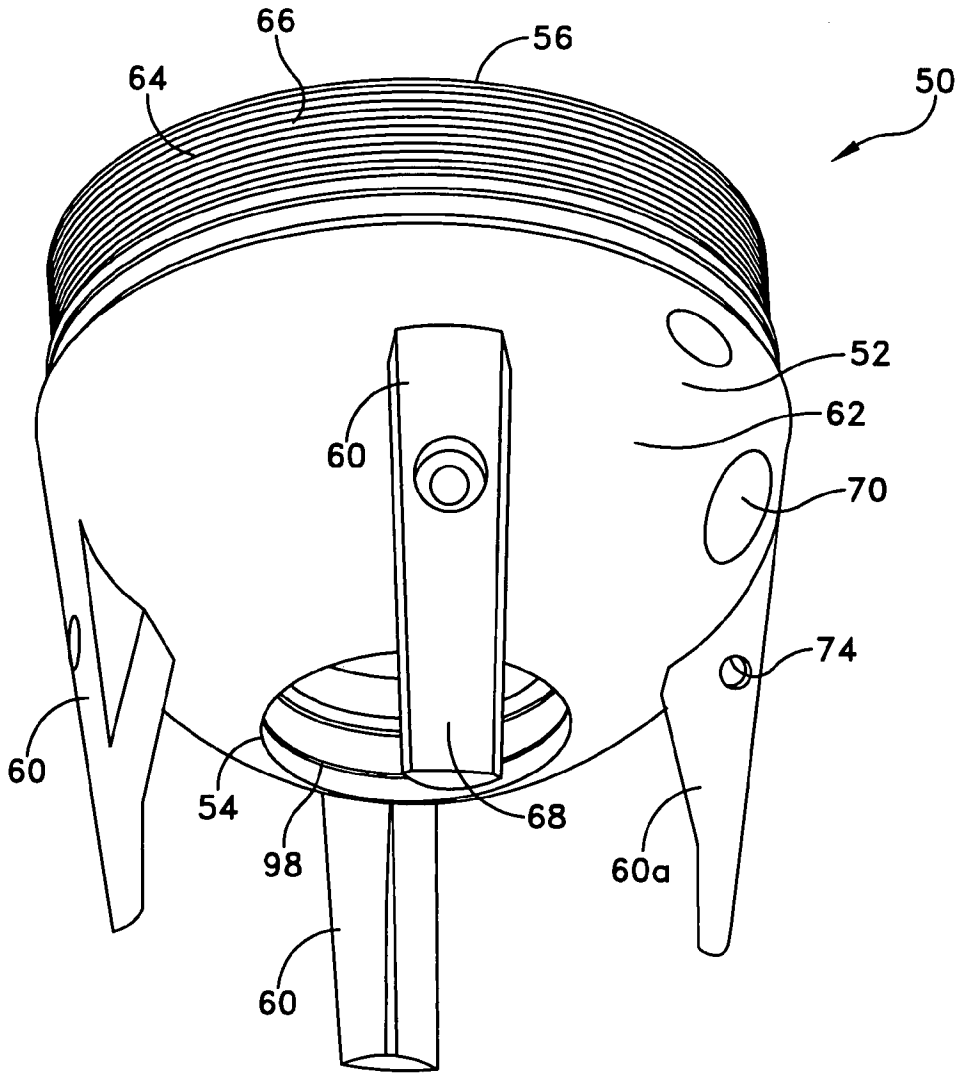
FIG. 4 is a further perspective view of the tailcone of FIGS. 2 and 3.

Referring to FIGS. 2–4, it will be seen that an illustrative tailcone assembly includes a tailcone 50 which may be cast or molded in one piece. The tailcone 50 includes a generally hemispherically shaped shell 52 having a planar aft end 54 and an annular open forward end 56.

A plurality of fins 60, preferably four, are shown extending from the shell 52. The fins 60 preferably are integral with the shell 52 and extend from the external surface 62 of the shell. As shown in FIG. 3, the fins 60 extend aft (downwardly as shown in FIG. 3) and incline inboard, as will be further discussed hereinbelow.

Figure 1:
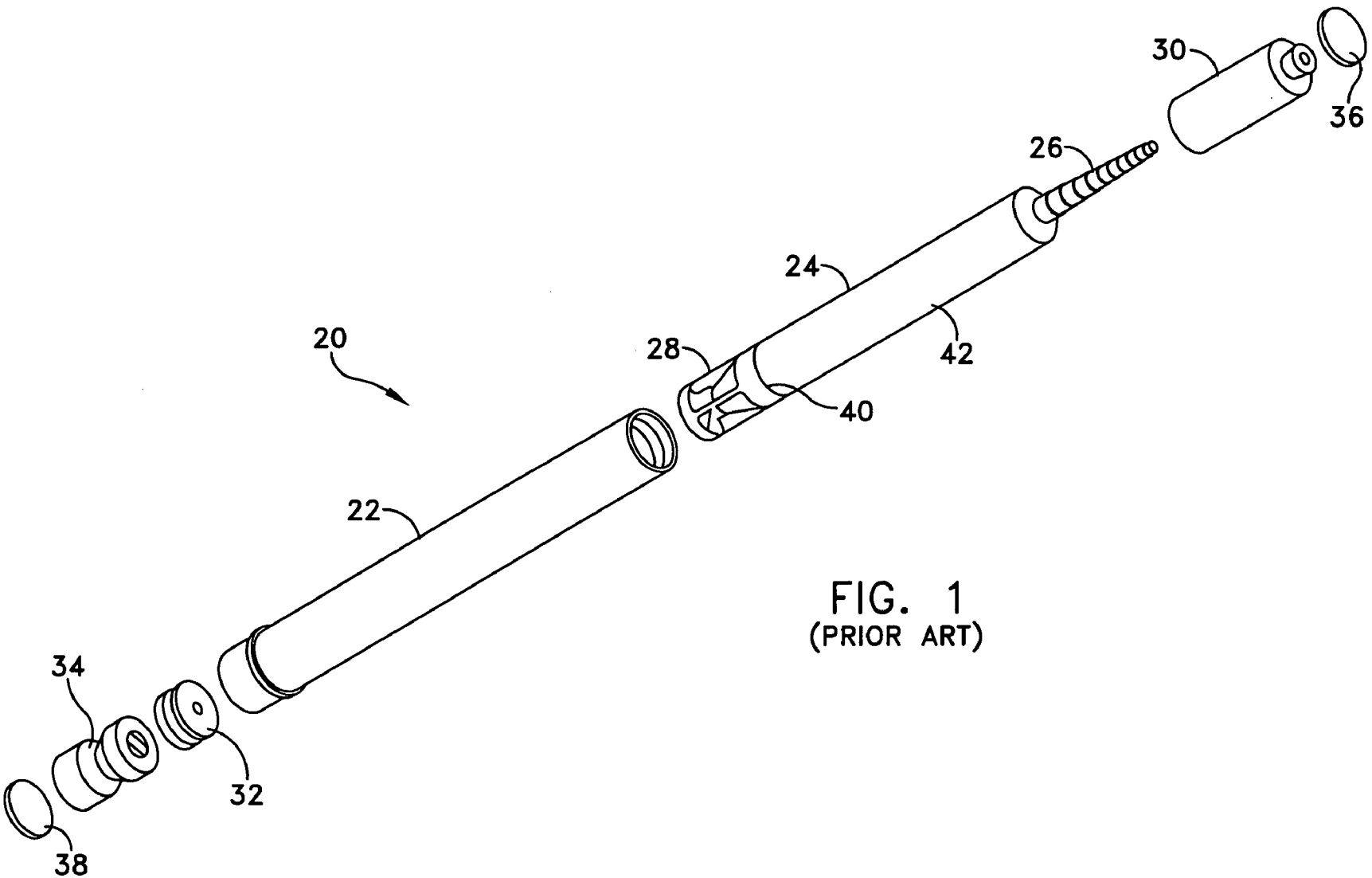
FIG. 1 (PRIOR ART)
FIG. 1 is an exploded perspective view of a prior art submarine countermeasure apparatus.

The shell 52 is provided with connector structure 64, preferably in the form of external threads 66, for connecting to an aft end of the countermeasure body portion 42 (FIG. 1). Alternate connections could include radial flat head fasteners, radial pins, and internal or external joint rings and clamps.

It has been established that the maximum pitch angle of a tailcone free to move widthwise in a conventional launch tube is less than seven degrees. That is, if a bending moment forces the centerline of the tailcone out of sync with the centerline of the launch tube, the angle between the centerlines has been found to be less than 7°.

In accordance with the present invention, outer surfaces 68 of the fins 60 are angled inwardly 7°, such that the fins 60 under maximum bending conditions do not jam against the inside wall of the launch tube 22.

Figure 5:
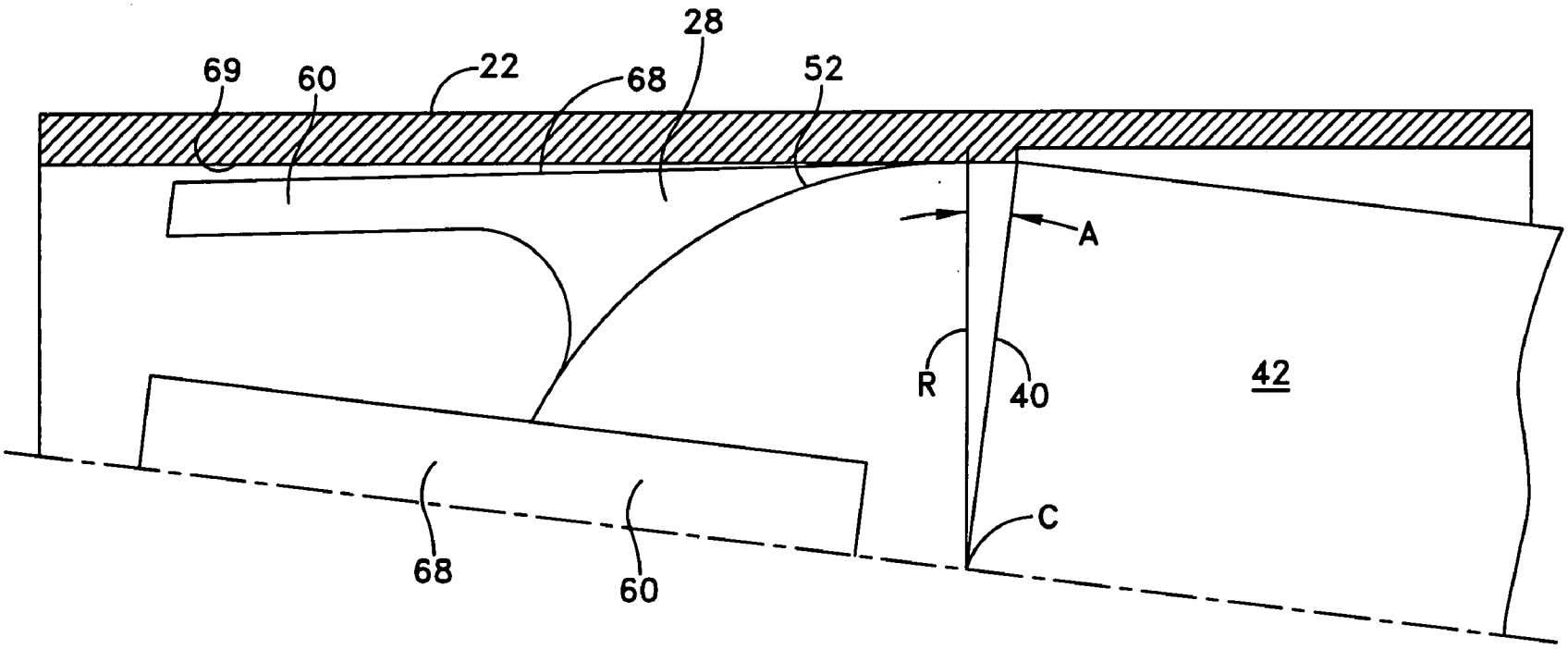
FIG. 5 is a diagrammatic illustration of the tailcone of FIGS. 2–4 positioned in a launch tube.

Referring to FIG. 5, it will be seen that the shell 52 is hemispherically shaped along a radius R from a center point C on the line of the joint 40. An angle A of about 7° is defined by the joint 40 and a radius R. The fin outer surfaces 68 extend normal to the radius line R. Thus, the fins 60 extend inwardly so as not to jam against the launch tube inside surface 69.

The shell 52 is provided with a first aperture 70 in the side thereof. The tailcone is provided with an umbilical cable 72 (FIG. 6) which is cut upon ejection of the counter-measure 24 from the launch tube 22. In the prior art, a clamp shear (not shown) is disposed on the tailcone. The tailcone provided herein is shorter and more compact than the prior art tailcone, and space in the present tailcone assembly for a clamp shear is problematic. Instead, the umbilical cable 72 is passed through the first aperture 70 and thence through a second aperture 74 extending through one 60*a* of the fins 60 most proximate to the first aperture 70.

In preparing the tailcone 50 for attachment to the countermeasure body portion 42, the cable 72 is looped, as at 76, and optionally knotted, as at 78. The cable 72 is passed through the second aperture 74 and looped, as at 80, on the other side of the fin 60*a*.

Preferably, cable straps 82 are held adjacent the fin 60*a* by a bolt 84 extending through the fin 60*a* and disposed proximate the second aperture 74. The cable straps 82 serve to stabilize the cable 72.

Figure 6:
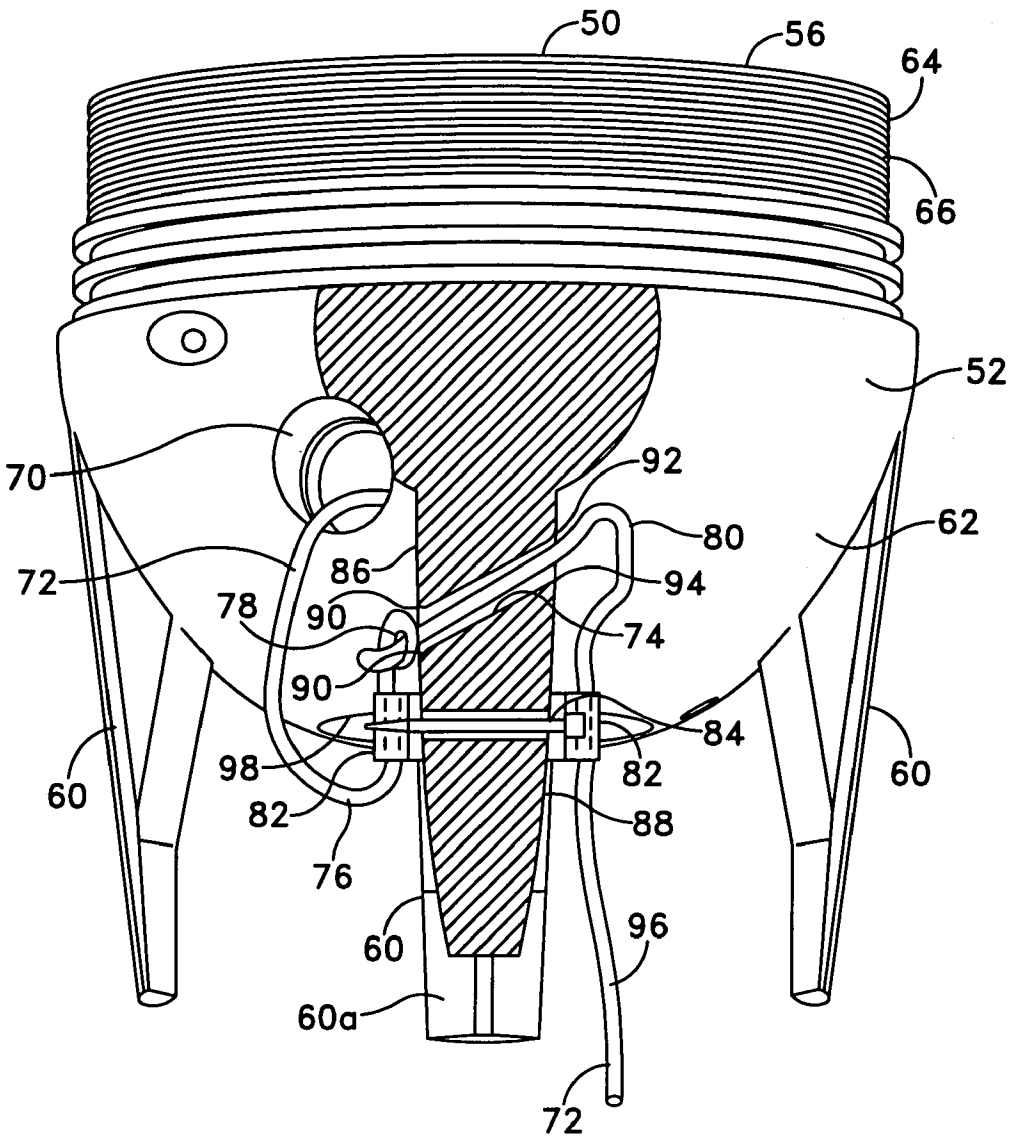
FIG. 6 is a further perspective view, partly in section, of the tailcone of FIGS. 2–4, shown with apparatus fixed thereto.

As seen in FIG. 6, the aperture 74 slants forwardly (upwardly as seen in FIG. 6) from a first side 86 of the fin 60*a* to a second side 88 of the fin 60*a*. Edges 90 of the second aperture 74 on the first side 86 of the fin 60*a* are rounded. A forward edge 92 of the second aperture 74 on the second side 88 of the fin 60*a* is also rounded. However, an after edge 94 of the second aperture 74 on the second side 88 of the fin 60*a* is formed as a cutting edge. Accordingly, tension applied to the cable 72 in an aft direction, as when the ram plate 32, to which the cable 72 is fixed, stops and the tailcone 50 continues moving forwardly in the launch direction, causes the cable 72 to move through the second cable strap 82 and forcefully engage the cutting edge 94 to sever the cable 72. The cable portion 96 aft of the cable cut slides through the cable strap 82 therearound and is left behind as the tailcone 50 and remainder of the countermeasure 24 exit the launch tube 22.

Figure 7:
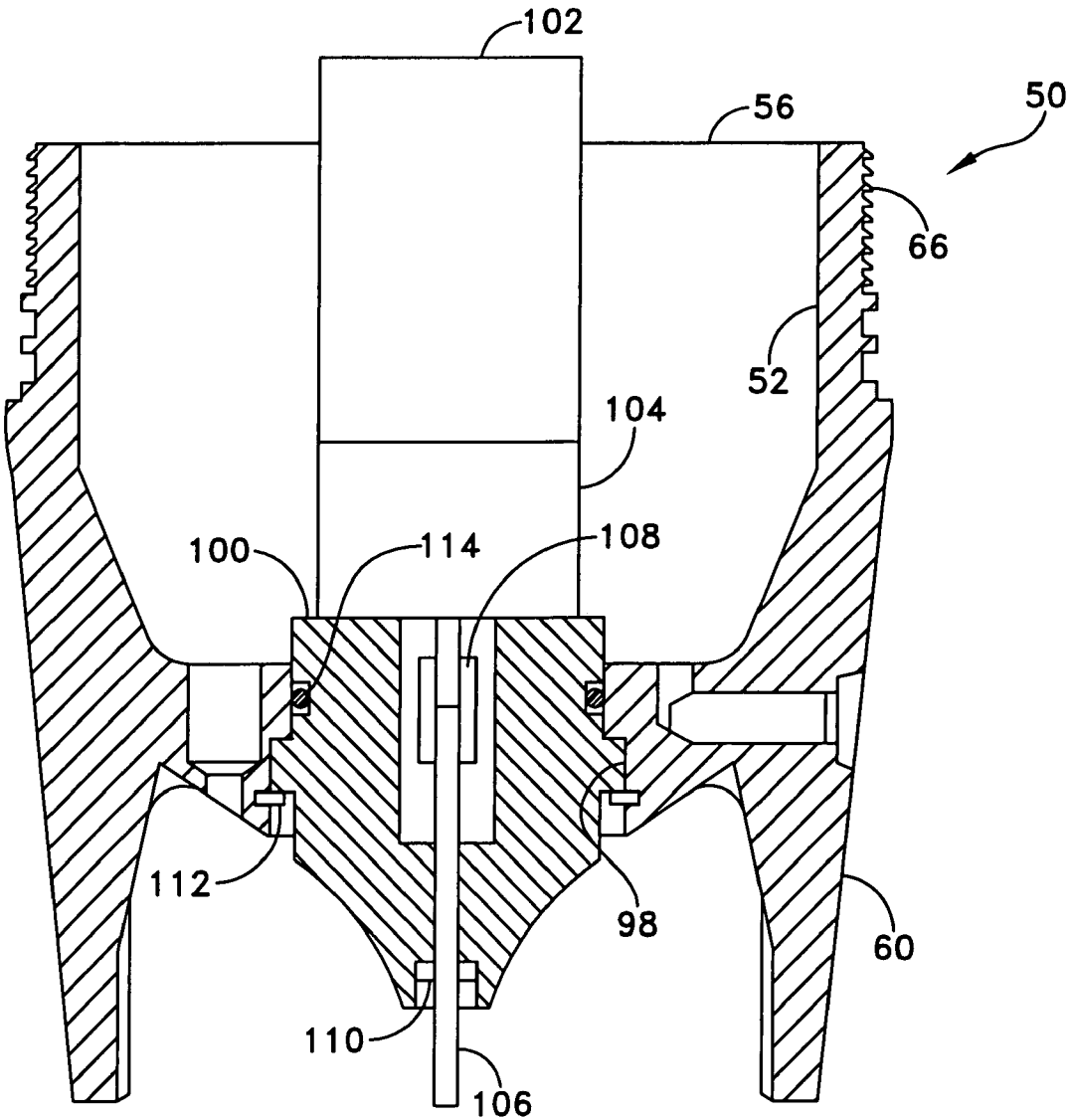
FIG. 7 is a sectional view of the tail cone of FIGS. 2–5, shown with further apparatus fixed thereto.

As shown in FIG. 7, the tailcone aft end 54 is provided with an opening 98 in which is disposed a shaft housing 100, a motor 102 and gearbox 104, a propeller shaft 106 connected to the gearbox 104, as by a coupling 108, and a seal/bearing 110. The entire motor-gearbox-shaft housing unit can be inserted from the outside of the tailcone 50, by slipping the unit into the opening 98 and securing it by a spiral ring 112. An o-ring 114 is provided to seal the shaft housing 100 in opening 98.

The new tailcone 50 provides the benefit of not jamming in the launch tube 22 and eliminates bending loads from the tailcone 50 joint 64 during an attempted launch under conditions of high bending moment. In addition, the tailcone described herein can be molded as an integral unitary shell and fin unit, of metal or plastics or composite materials, which reduces substantially the cost of the unit. Further, the new tailcone described herein permits for a shorter length than the prior art tailcone, by about four inches, thereby permitting four additional inches of length in the countermeasure for additional equipment. Still further, the umbilical cable cutting feature replaces a prior art clamp shear which was an expensive discrete cutting implement.

There is thus presented an improved tailcone in which the aforementioned bending moment problem has been essentially eliminated and which provides additional salutary improvements.

It will be understood that many additional changes in the details and arrangement of parts which have been herein described and illustrated in order to explain the nature of the invention, may be made by those skilled in the art within the principles and scope of the invention as expressed in the appended claims. For example, it has been found that three fins, as well as four, are suitable for implementation of the above noted features, and still provide the necessary structural integrity.

What is claimed is:

1. A tailcone assembly for a submarine countermeasure comprising:

a shell having an aft end and an annular open forward end said shell having a maximum diameter, said shell generally tapering from forward to aft, said shell having an opening centrally located in said shell aft end, extending therethrough and being adapted to retain a shaft assembly therein;

at least three fins fixed to said shell equidistantly around said shell externally thereof, each of said fins having a planar outermost surface, with respect to the longitudinal axis of said shell, extending aft and inboard of said shell, said fins being disposed completely within the cross section of said shell;

a connector structure on the forward end of said shell for connecting to an aft end of the countermeasure.

2. The tailcone assembly in accordance with claim 1 wherein said fins extend aft and inboard of said shell at an angle of about seven degrees.

3. The tailcone assembly in accordance with claim 2 wherein said shell generally tapers in a hemispheric manner and said fins are joined tagentially to said shell.

4. The tailcone assembly in accordance with claim 1 wherein said connector structure is chosen from connector structures including radial flat head fasteners, radial pins, internal joint rings, external joint rings, internal clamps and external clamps.

5. The tailcone assembly in accordance with claim 1 wherein said connector structure comprises threads for threaded engagement with the aft end of the countermeasure.

6. The tailcone assembly in accordance with claim 5 wherein said threads are external threads.

7. The tailcone assembly in accordance with claim 1 wherein:

said shell has a first aperture in a side thereof;

one said fin has a second aperture extending therethrough, wherein said first aperture is adjacent said one said fin such that said first aperture is proximate said second aperture; and further comprising a cable extending from inside said shell through said first aperture to the outside of said shell and through said second aperture in said fin.

8. The tailcone assembly in accordance with claim 7 wherein said second aperture slants forwardly from a first side of said one fin to a second side of said one fin, edges of the second aperture on the first side of said one fin being rounded, an aft edge of the second aperture on the second side of said one fin being a cutting edge, such that tension applied to said cable in an aft direction causes said cable to forcefully engage the cutting edge for severing said cable.

9. The tailcone assembly in accordance with claim 8 further comprising:

a bolt extending through said one fin; and cable straps joined to said bolt retaining said cable aft of where said cable extends through said second aperture.

10. The tailcone assembly in accordance with claim 1 further comprising an engine shaft assembly positioned in said shell opening.

11. The tailcone assembly in accordance with claim 10 wherein said opening is sized to allow removal of said engine shaft assembly through said shell opening.

12. The tailcone assembly in accordance with claim 11 further comprising:

a seal positioned in said shell opening for sealing said engine shaft assembly against said shell opening; and a retaining means positionable in said shell opening for retaining said engine shaft assembly within said shell opening.

* * * * *